US007455399B2

(12) United States Patent
Senior et al.

(10) Patent No.: US 7,455,399 B2
(45) Date of Patent: Nov. 25, 2008

(54) INKJET PRINTHEAD PRIMER FOR A PRINTING DEVICE

(75) Inventors: Alan Joseph Senior, San Diego, CA (US); Timothy J. Carlin, San Diego, CA (US); Kevin T. Kersey, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 414 days.

(21) Appl. No.: 11/363,294

(22) Filed: Feb. 23, 2006

(65) Prior Publication Data

US 2007/0195136 A1 Aug. 23, 2007

(51) Int. Cl.
*B41J 2/175* (2006.01)
*B41J 2/165* (2006.01)

(52) U.S. Cl. ..... 347/87; 347/30

(58) Field of Classification Search ..... 347/29, 347/30, 84, 85, 87

See application file for complete search history.

(56) References Cited

U.S. PATENT DOCUMENTS 4,170,016 A 10/1979 Geil
4,517,577 A 5/1985 Miranda et al.
5,526,030 A * 6/1996 Baldwin et al. ..... 347/87
5,719,609 A * 2/1998 Hauck et al. ..... 347/85
5,764,259 A * 6/1998 Nakajima ..... 347/86
5,812,168 A 9/1998 Pawlowski, Jr. et al.
5,847,734 A 12/1998 Pawlowski, Jr.
5,988,803 A * 11/1999 Komplin et al. ..... 347/86
6,283,576 B1 9/2001 Premnath et al.
6,419,343 B1 7/2002 Taylor et al.
6,843,557 B2 1/2005 Matsumoto

* cited by examiner

*Primary Examiner*—Anh T. N. Vo

(57) ABSTRACT

An inkjet printhead for a printing device includes a fluid reservoir operatively disposed within the printhead and a pressure regulation system in fluid communication with the fluid reservoir. The inkjet printhead also includes a nozzle plate having at least one nozzle, wherein the nozzle is in fluid communication with the fluid reservoir; as well as a vent port in fluid communication with the pressure regulation system. Further, the inkjet printhead for a printing device includes a passive vent in fluid communication with the vent port. The passive vent is configured to dissipate air pressure accumulated in the pressure regulation system during priming. The passive vent provides a controlled decay time for the priming air pressure.

19 Claims, 2 Drawing Sheets

INKJET PRINTHEAD PRIMER FOR A PRINTING DEVICE

BACKGROUND

The present disclosure relates generally to printing devices, and more particularly to a method and apparatus for priming an inkjet printhead.

Blow priming is a method of servicing a printhead whereby fluid is forced out of the nozzles to flush debris and/or air from the nozzles. Blow priming is performed by applying air pressure to the printhead pressure regulation system, thereby forcing fluid out of the nozzles. Dissipating the air pressure allows the pressure regulation system to reduce and return the printhead's internal pressure to normal. Fluid remaining on the nozzle plate is either drawn back into the printhead, or it is removed before re-entering the printhead.

Priming a printhead that contains multiple fluids may result in mixed waste fluid being undesirably drawn back into the printhead, which may require substantial servicing after blow priming in order to clean the nozzles.

As such, it would be desirable to provide a method and system for priming a printhead containing multiple fluids whereby waste fluid is substantially prevented from re-entering the printhead and contaminating stored fluid.

BRIEF DESCRIPTION OF THE DRAWINGS

Features and advantages of the present disclosure will become apparent by reference to the following detailed description and drawings, in which like reference numerals correspond to similar, though not necessarily identical components. For the sake of brevity, reference numerals or features having a previously described function may not necessarily be described in connection with other drawings in which they appear.

DETAILED DESCRIPTION

Method(s) and system(s) are described herein whereby a potential problem of fluid contamination of a printhead during priming operations of an inkjet printer may be substantially obviated.

In general in the embodiment(s) described herein, priming seals contact the top of an inkjet printhead at each port. Each seal incorporates a slow-bleed passive vent that allows the printhead to function during normal operation, but also advantageously serves to slow down the end of a priming operation while the nozzle plate is cleaned of waste fluid. The seal substantially prevents priming waste fluid from being drawn back into the nozzle and contaminating the fluid in the printhead.

Figure 1:
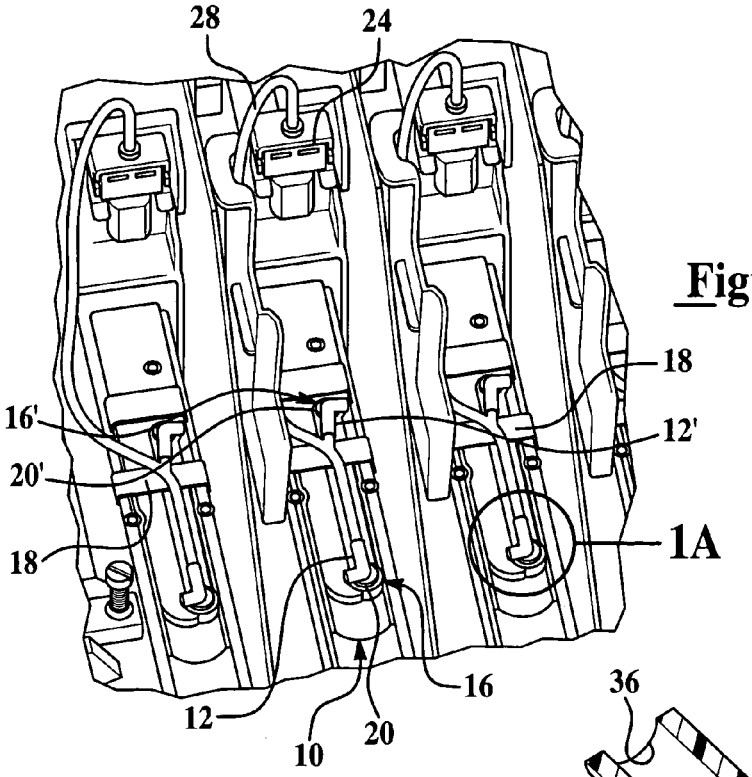
FIG. 1 is a cutaway perspective view of an embodiment of a set of printheads installed in a printing device.

Referring now to FIG. 1, a perspective view of an embodiment of a passive venting system engaged with a printhead 10 in a printing device is illustrated. A passive vent 12, 12' is engaged with the printhead 10 at the vent port 16, 16'. For example, the passive vent 12, 12' may be releasably engaged to the printhead 10 via a clip 18. The passive vent 12, 12' is disposed in the priming seal 20, 20' such that the passive vent 12, 12' is sealingly engaged with the vent port 16, 16'. The printhead 10 embodiment in FIG. 1 includes two vent ports 16, 16', however, it is to be understood that there may be one vent port 16, or any number of vent ports 16, 16', as desired.

Figure 1A:
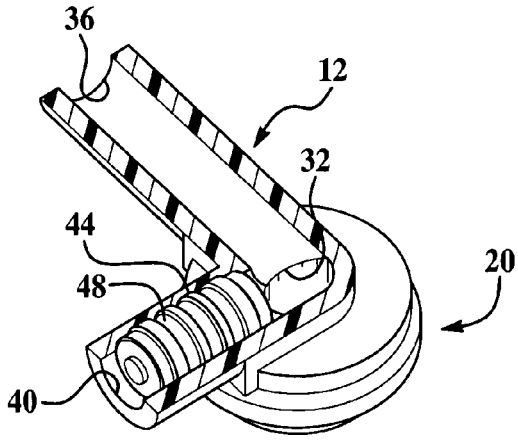
FIG. 1A is an enlarged, cutaway, cross-sectional perspective view of the area shown at 1A in FIG. 1, showing the top surface region of an embodiment of a passive vent fitted with an embodiment of a labyrinth screw.
Figure 1B:
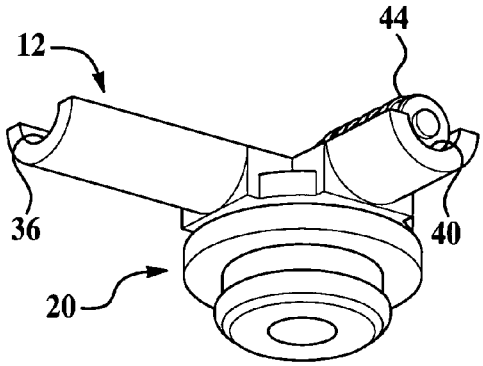
FIG. 1B is a view similar to that of FIG. 1A, but showing a bottom surface region embodiment.

FIGS. 1A and 1B illustrate a cross-sectional perspective view of an embodiment of a passive vent 12. The latch associated with the printhead 10, which may generally obscure the view, is not shown in the figure. The vent 12 includes three openings: opening 32 to the printhead 10, opening 36 to the air pump 24, and opening 40 to ambient. The air pump 24 is operatively engaged with the passive vent opening 36 via the air tube 28, whereby pressurized air from the air pump 24 passes through the air tube 28 and into the passive vent 12 through the opening 36. Air pumped into the passive vent 12 through the opening 36 may pass into the pressure regulating system 84 for blow priming via passive vent opening 32. After the printhead 10 has been blow primed, the priming air pressure may be released from the printhead 10 via passive vent opening 32, and then released to ambient via passive vent opening 40.

Figure 2:
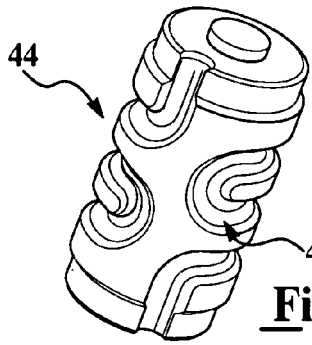
FIG. 2 is an enlarged, perspective view of the bottom surface region of the embodiment of a labyrinth screw shown in FIG. 1A.

Passive vent opening 40 may, in an embodiment, be fitted with a labyrinth screw 44, as illustrated in FIGS. 1A and 2. The labyrinth screw 44 may provide a tortuous path 48 whereby the flow of air through the path 48 is controlled. FIG. 2 illustrates the opposed side view of the labyrinth screw 44 of FIG. 1A, whereby the tortuous path 48 is visible on the surface of the labyrinth screw 44.

It is to be understood that the passive vent 12, 12' may be accomplished by a variety of mechanisms in place of the embodiment(s) shown in the figures. Some non-limiting examples of alternate embodiments of passive vent 12, 12' may include worm trails, filters, fluid traps, capillary tubes, metering orifices, and/or the like.

Figure 3:
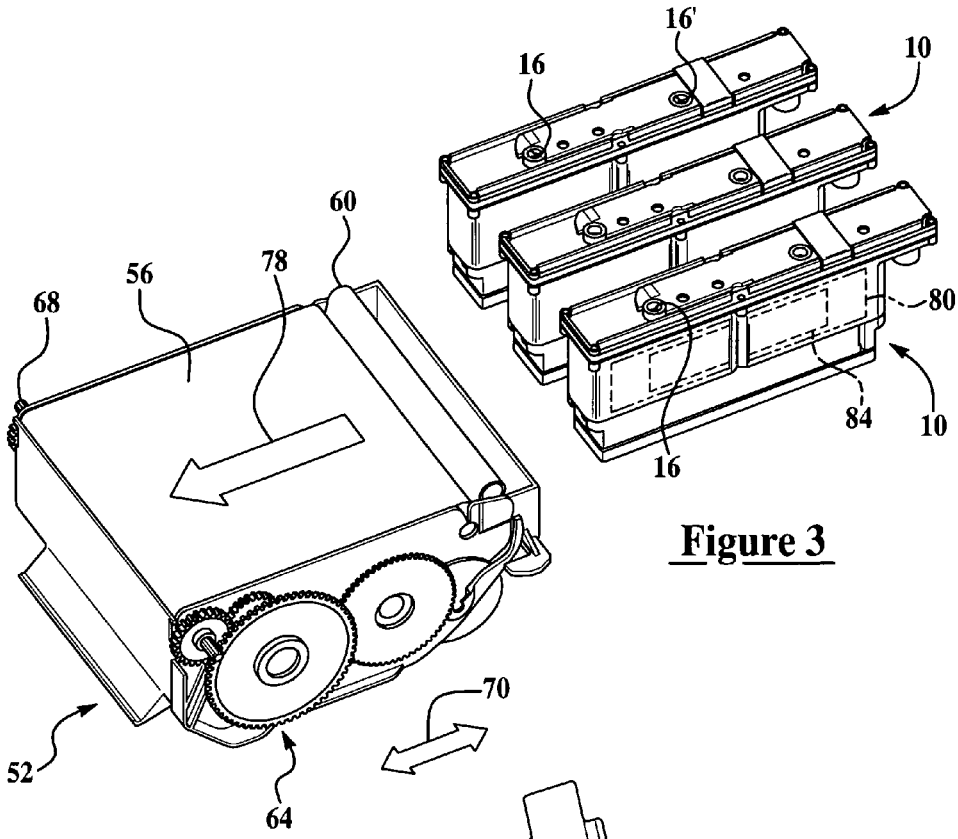
FIG. 3 is a perspective view of an embodiment of a set of printheads in exploded alignment with an embodiment of a web wipe cartridge (showing the upper surface regions thereof)
Figure 4:
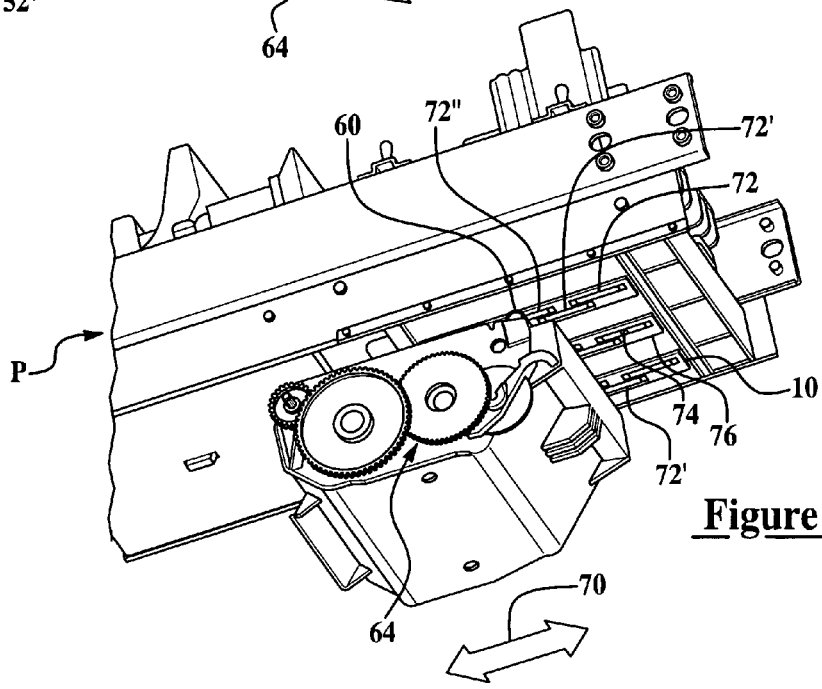
FIG. 4 is a cutaway, perspective view of the embodiment of the set of printheads and web wipe cartridge of FIG. 3 (showing the lower surface regions thereof), shown installed in an embodiment of a printing device.

Referring now to FIGS. 3 and 4 together, in an embodiment of inkjet printhead 10 for a printing device P (a cutaway view of an embodiment of which is shown in FIG. 4), the printhead 10 includes a fluid reservoir 80 operatively disposed within the printhead 10. The printhead 10 also includes a pressure regulation system 84 in fluid communication with the fluid reservoir 80. One or more nozzle plates 72, 72', 72", each having one or more nozzles 74 disposed therein, are operatively disposed within the printhead 10 in any suitable configuration and by any suitable means. In an embodiment, one or more nozzle plates 72, 72', 72" may be defined in a snout 76. It is to be understood that the nozzle(s) is/are in fluid communication with the fluid reservoir 80.

In an embodiment of the method wherein the printhead 10 includes more than one nozzle plate 72, 72', 72", the printhead 10 may be adapted to simultaneously house and substantially simultaneously or sequentially eject at least two types of fluid, whereby each nozzle plate 72, 72', 72" may, if desired, be dedicated to a different type of fluid. In an embodiment, each of the nozzle plates 72, 72', 72" may be adapted to substantially simultaneously or sequentially eject more than one type of fluid per plate 72, 72', 72". As a non-limitative example, each nozzle 74 of an individual nozzle plate 72, 72', 72" may, if desired, be adapted to eject a different (e.g. different from any other nozzles 74 in any of the nozzle plates 72, 72', 72", or different from some of the other nozzles 74) type of fluid substantially simultaneously or sequentially.

It is to be understood that another printhead 10 embodiment may include one or more nozzle plates 72, 72', 72" and/or may be adapted to house and eject one or more types of fluid. Non-limiting examples of types of fluid include various types of printing fluids and inks, such as different colored inks, invisible, visible, and magnetic inks, as well as ink fixer, and/or the like.

Further, FIG. 3 illustrates an embodiment of a set of printheads 10 in exploded alignment with a web wipe cartridge 52. The web wipe cartridge 52 includes a cloth 56 engaged with a roller 60 and a gear system 64, which is engaged with a spool 68. The roller 60 may be a foam wiping roller. The web wipe cartridge 52 removes waste fluid from the snout 76 and/or the nozzle plate 72, 72', 72" after the printhead 10 has been blow primed. In one embodiment, the cloth 56 contacts the nozzle plate 72, 72', 72", and the gear system 64 rotates to advance the cloth 56 by winding it onto the spool 68 in the direction of the arrow 78. The waste fluid is wiped from the nozzle plate 72, 72', 72" by the cloth 56. The web wipe cartridge 52 may advance in either direction along the length of the printhead 10, as illustrated at 70. During removal of waste fluid from the nozzle plate 72, 72', 72", the service station may run the web wipe cartridge 52, and, thus, the cloth 56, along substantially the entire length of the printhead 10.

FIG. 4 illustrates an embodiment of a set of printheads 10 and a web wipe cartridge 52. In FIG. 4, the associated service station, which may generally obscure the view, is not shown in the figure. In an embodiment, three printheads 10 are defined in a printing device unit P, whereby each printhead 10 includes five nozzle plates 72, 72', 72" (three of which are shown).

Referring now to FIGS. 1, 3 and 4 together, blow priming is the process of pressurizing the fluid within the printhead 10 to eject a predetermined amount of the fluid through the nozzle(s) 74. Blow priming may be a method of servicing a printhead 10. The fluid may be forced out of the nozzle(s) to help flush debris from the printhead 10 and/or substantially prevent or dissolve clogs in the nozzle(s).

In one embodiment, the priming air pressure applied to the pressure regulation system 84 is generated in an air pump 24 in fluid communication with the pressure regulation system 84. As contemplated herein, the pressure regulation system 84 may be any system that is adapted to control and/or balance pressures within the printhead 10. For example, the pressure regulation system 84 may maintain pressures within the printhead 10 such that fluid neither drips out of the nozzle (s) nor is drawn back into the printhead 10.

In an embodiment of pressure regulation system 84, a flexible bag is located within the printhead 10 whereby the bag may be selectively inflated via the vent port 16, 16' such that pressure is exerted on the fluid located external to the bag (for example, within the fluid reservoir 80) within the printhead 10.

An air pump 24 may provide air pressure to the vent ports 16, 16' such that the pressure inside the printhead 10 increases, and fluid is forced out of the nozzle(s) located generally opposite the vent ports 16, 16' on the printhead 10. In an embodiment, the air pump 24 pumps air through the air tube 28 and through the vent port 16, 16' to inflate the flexible bag 84 located within the printhead 10. The inflated flexible bag 84 causes the pressure on the fluid within the reservoir 80 to increase, whereby the fluid is forced out of the printhead 10 through the nozzle(s). In an embodiment, the priming air pressure applied to the pressure regulation system 84 is between about 1.5 psi and about 2.5 psi. However, it is to be understood that the priming air pressure may be at any desired pressure/range of pressures for a particular printhead 10 and/or desired result.

After the printhead 10 has been blow primed, the pressure in the printhead 10 may be dissipated whereby the internal printhead 10 pressure returns to normal. If the fluid that is forced out of the nozzle(s), or waste fluid, is allowed to remain on the nozzle plate 72, 72', 72" while the printhead 10 blow priming pressure is released, the waste fluid may be undesirably drawn back into the printhead 10 through the nozzle(s). If waste fluid is drawn back into the nozzle(s) it may contaminate the fluid within the printhead 10, whereby the nozzle(s) may require post-prime servicing to clean it/them.

One non-limiting advantage of embodiment(s) of the passive vent 12, 12' is its capacity to balance the printhead 10 internal pressure such that fluid is neither dripping from the nozzle(s) nor being drawn back into the printhead 10 after the printhead 10 has been blow primed. As such, the passive vent 12, 12' controllably releases the priming pressure from the printhead 10 after it has been blow primed such that waste fluid remaining on the nozzle plate 72, 72', 72" may be removed.

In an embodiment, vent port 16, 16' is in fluid communication with the pressure regulation system 84. The passive vent 12, 12' is in fluid communication with the vent port 16, 16', respectively, wherein the passive vent 12, 12' is configured to dissipate air pressure accumulated in the pressure regulation system 84 during priming. Without being bound to any theory, it is believed that the passive vent 12, 12' provides a controlled decay time for priming air pressure so as to provide sufficient time for waste fluid to be removed from the nozzle plate 72, 72', 72" substantially without being drawn into the printhead 10.

It is to be understood that the vent port 16, 16' may also serve functions unrelated to the blow priming as described herein. For example, the vent port 16, 16' may equalize internal and external printhead 10 pressures, limit the peak internal printhead 10 pressure, maintain a slight negative pressure inside the printhead 10, and/or regulate fluid entry into the printhead 10 from the fluid reservoir 80 during printing.

Further, it is to be understood that the fluid reservoir 80 may be any system, device, or component that is adapted to house fluid. The fluid reservoir 80 may be operatively disposed within the printhead 10, whereby the fluid reservoir 80 may be completely contained within the printhead 10, partially disposed in the printhead 10, or in fluid communication with but external to the printhead 10.

An embodiment of a method of priming a printhead 10 for a printing device P includes the steps of applying priming air pressure to a pressure regulation system 84 in fluid communication with a fluid reservoir 80 and controlling the decay time of the priming air pressure. The fluid reservoir 80 is in fluid communication with a nozzle plate 72, 72', 72", and priming air pressure forces fluid out of the nozzle(s) 74 and onto the associated nozzle plate 72, 72', 72". The decay time is controlled in such a way as to allow removal of waste fluid from the nozzle plate 72, 72', 72", for example, by dissipating the priming air pressure through a passive vent 12, 12'.

In an embodiment, a web-wipe cartridge 52 makes contact with the nozzle plate 72, 72', 72" such that waste fluid is wiped from the nozzle plate 72, 72', 72" by the web-wipe cartridge 52.

It is to be understood that, in an embodiment, the passive vent 12, 12' may include: a tortuous flow path 48 configured to provide a controlled decay time for printhead 10 priming air pressure; and a priming seal 20, 20' in fluid communication with the flow path 48. The priming seal 20, 20' may be operatively engageable with vent port 16, 16', respectively. The vent port 16, 16' may be in fluid communication with pressure regulation system 84, which is in fluid communication with nozzle.

The printhead 10 in embodiment(s) disclosed herein may include the priming seal 20, 20' in leak-resistant engagement with the vent port 16, 16', wherein the passive vent 12, 12' is operatively defined within and/or contiguous to the priming seal 20, 20', which may be fastened to the printhead 10.

A non-limiting example of a passive vent 12, 12' operatively defined within a priming seal 20, 20' is a labyrinth screw 44. It is to be understood that the priming seal 20 may alternately be disposed in clip 18 (shown in FIG. 1) adapted to mount to the printhead 10. It is to be further understood that in one embodiment, the clip 18 is separate from a latch adapted to mount the printhead 10 to the printing device P. In an alternate embodiment, the priming seal 20 may be incorporated into the latch adapted to mount the printhead 10 to the printing device P.

The decay time may be controlled by bleeding off air pressure accumulated in the pressure regulation system 84 during priming. Furthermore, in an embodiment, subsequent to bleeding off priming air pressure, the air pressure in the pressure regulation system 84 may be substantially equivalent to air pressure ambient to the printhead 10.

The vent ports 16, 16', whereby priming air pressure is applied to the printhead 10, are visible in FIG. 3. The nozzle (s) and nozzle plate 72, 72', 72" are located on the side of the printhead 10 opposing the vent port 16, 16', as illustrated in FIG. 4. In one embodiment, each printhead 10 includes five nozzle plates 72, 72', 72" adjacent to/defined in one snout 76.

Referring yet again to FIG. 4, an embodiment of a fluid reservoir 80 is shown. Additionally, the pressure regulation system 84 may be at least partially disposed within the fluid reservoir 80. In the embodiment illustrated in FIG. 4, the fluid reservoir 80 is a substantially rigid housing for storing fluid. In this embodiment, the pressure regulation system 84 includes the flexible bag (as discussed above), whereby air pumped into the flexible bag increases the pressure in the flexible bag, thereby exerting pressure on the fluid through the flexible walls of the bag. The pressure realized by the fluid within the fluid reservoir 80 as a result of the air pumped into the flexible bag forces fluid out of the nozzle(s), whereby the printhead 10 is blow primed.

It is to be understood that waste fluid, as used herein, may include a mixture of at least two types of fluid.

As used herein, it is to be understood that the term "fluid communication" is to be broadly defined to encompass a variety of divergent connected arrangements and assembly techniques. These arrangements and techniques include, but are not limited to (1) the direct fluid communication of two components, devices, systems, fluids, the like, and/or combinations thereof with no intervening components therebetween; and (2) the fluid communication of two components, devices, systems, fluids, the like, and/or combinations thereof with one or more components therebetween, provided that the two components, devices, systems, fluids, the like, and/or combinations thereof are somehow in operative fluid communication with each other (notwithstanding the presence of one or more additional components therebetween). For example, priming air pressure may be in fluid communication with a fluid reservoir 80 although a flexible bag of the pressure regulation system 84 may be disposed therebetween.

It is also to be understood that the terms "engage/engaged/engagement/engageable" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "engaged with" the other component is somehow in operative communication with the other component (notwithstanding the presence of one or more additional components therebetween). Additionally, two components may be permanently, semi-permanently, or releasably engaged with one another.

Further, it is to be understood that the terms "top," "bottom," "upper," "lower" and/or like terms are not intended to be limited to, nor necessarily meant to convey a spatial orientation, but rather are used for illustrative purposes to differentiate views of the printheads, web wipe cartridge, etc. It is to be further understood that embodiment(s) of the present disclosure may be used in any suitable/desirable spatial orientation.

While several embodiments have been described in detail, it will be apparent to those skilled in the art that the disclosed embodiments may be modified. Therefore, the foregoing description is to be considered exemplary rather than limiting.

What is claimed is:

1. An inkjet printhead for a printing device, the printhead comprising:

a fluid reservoir operatively disposed within the printhead;

a pressure regulation system in fluid communication with the fluid reservoir;

a nozzle plate having at least one nozzle in fluid communication with the fluid reservoir;

a vent port in fluid communication with the pressure regulation system;

a priming seal in leak-resistant engagement with the vent port, wherein a passive vent is operatively defined within the priming seal; and the passive vent in fluid communication with the vent port, the passive vent configured to dissipate air pressure accumulated in the pressure regulation system during priming, whereby the passive vent provides a controlled decay time for the priming air pressure.

2. The printhead as defined in claim 1 wherein the printhead comprises more than one nozzle plate, each plate having a plurality of nozzles associated therewith.

3. The printhead as defined in claim 1 wherein the printhead is adapted to simultaneously house the at least two types of fluid and to eject the at least two types of fluid substantially simultaneously or sequentially.

4. The printhead as defined in claim 1 wherein the priming air pressure applied to the printhead internal pressure regulation system is between about 1.5 psi and about 2.5 psi.

5. The printhead as defined in claim 1 wherein the priming seal is disposed in a clip adapted to mount to the printhead.

6. A method of priming a printhead for a printing device, the method comprising the steps of:

applying priming air pressure to a pressure regulation system in fluid communication with a fluid reservoir, the fluid reservoir in fluid communication with a nozzle, the priming air pressure forcing fluid out of the nozzle and onto a nozzle plate associated with the nozzle; and controlling the decay time of the priming air pressure to allow removal of waste fluid from the nozzle plate.

7. The method as defined in claim 6 wherein the decay time is controlled by bleeding off air pressure accumulated in the pressure regulation system during priming.

8. The method as defined in claim 7 wherein subsequent to bleeding off air pressure accumulated in the pressure regulation system during priming, the air pressure in the pressure regulation system is substantially equivalent to air pressure ambient to the printhead.

9. The method as defined in claim 6 wherein the printhead comprises more than one nozzle plate, each plate having a plurality of nozzles associated therewith.

10. The method as defined in claim 9 wherein the printhead is adapted to simultaneously house at least two types of fluid, the printhead adapted to eject the at least two types of fluid substantially simultaneously or sequentially.

11. The method as defined in claim 10 wherein the waste fluid is a mixture of the at least two types of fluid.

12. The method as defined in claim 6 wherein the priming air pressure applied to the pressure regulation system is between about 1.5 psi and about 2.5 psi.

13. The method as defined in claim 6 wherein controlling the decay time of the priming air pressure is achieved by dissipating the priming air pressure through a passive vent.

14. The method as defined in claim 13 wherein the passive vent is operatively defined within a priming seal operatively disposed in a clip adapted to releasably engage to the printhead.

15. The method as defined in claim 13 wherein the passive vent is operatively defined within a priming seal fastened to the printhead.

16. The method as defined in claim 6 wherein the priming air pressure applied to the pressure regulation system is generated in an air pump in fluid communication therewith.

17. A passive vent for a printhead, the passive vent comprising:

a tortuous flow path configured to provide a controlled decay time for printhead priming air pressure; and a priming seal in fluid communication with the flow path, and operatively engageable with a vent port in fluid communication with a pressure regulation system, the pressure regulation system in fluid communication with a nozzle having a nozzle plate.

18. The passive vent as defined in claim 17 wherein the printhead is adapted to simultaneously house the at least two types of fluid and to eject the at least two types of fluid substantially simultaneously or sequentially.

19. The passive vent as defined in claim 17 wherein the priming air pressure applied to the printhead is generated in an air pump in fluid communication with the printhead.

* * * * *